US006481677B1

(12) United States Patent
Yu

(10) Patent No.: US 6,481,677 B1
(45) Date of Patent: Nov. 19, 2002

(54) HANGER

(76) Inventor: Ming-Ti Yu, 122-5, Jun Liao Rd., Feng Yuan, Taichung Hsien (TW)

( * ) Notice: Subject to any disclaimer, the term of this patent is extended or adjusted under 35 U.S.C. 154(b) by 0 days.

(21) Appl. No.: 10/024,604

(22) Filed: Dec. 17, 2001

(51) Int. Cl.[7] ..... G10D 3/00

(52) U.S. Cl. ..... 248/220.41; 211/59.1; 84/327

(58) Field of Search ..... 248/220.22, 220.41, 248/222.51, 224.8, 240, 241, 282.1, 283.1, 289.11, 443; 211/85.6, 96, 105.1, 105.2, 106.01, 59.1; 84/327

(56) References Cited

U.S. PATENT DOCUMENTS 4,104,817 A * 8/1978 Herzog ..... 211/59.1
4,182,505 A * 1/1980 Cobin ..... 248/220.41
4,516,681 A * 5/1985 Jahel ..... 211/104
4,783,033 A * 11/1988 Valiulis ..... 211/59.1
4,871,135 A * 10/1989 Thalenfeld ..... 211/57.1
5,078,276 A * 1/1992 Rogge et al. ..... 211/18
5,454,473 A * 10/1995 Hennessey ..... 211/189
5,769,372 A * 6/1998 Klosterman ..... 248/217.3
6,091,008 A * 7/2000 Yu ..... 248/220.41
6,349,909 B1 * 2/2002 Zarrow et al. ..... 211/57.1

* cited by examiner

*Primary Examiner*—Romon O. Ramirez
*Assistant Examiner*—Jon Szumny

(57) ABSTRACT

A hanger has a support frame, an L-shaped rod, a clamp seat, a connection pipe, and a bracket. The support frame has a hollow post, a fork-shaped frame disposed on the hollow post, and a positioning seat disposed on the hollow post. The connection pipe has a rear end inserted in the clamp seat. The bracket has a tube and a U-shaped rod. A lower end of the L-shaped rod is inserted in the hollow post. A bolt fastens the clamp seat and the rear end of the connection pipe together. A front end of the connection pipe is inserted in the tube.

5 Claims, 4 Drawing Sheets

HANGER

BACKGROUND OF THE INVENTION

The present invention relates to a hanger. More particularly, the present invention relates to a hanger which is easily detached.

A conventional music instrument hanger has a U-shaped bracket to receive a music instrument such as a guitar. However, an angle of the conventional music instrument hanger cannot be adjusted.

SUMMARY OF THE INVENTION

An object of the present invention is to provide a hanger which is easily detached.

Another object of the present invention is to provide a hanger which has a connection pipe to be rotated in order to adjust an angle of the hanger.

Another object of the present invention is to provide a hanger which has a positioning seat having a plurality of round holes and an L-shaped rod having a positioning rod inserted through one of the round holes of the positioning seat so that a direction of the L-shaped rod can be adjusted.

Accordingly, a hanger comprises a support frame, an L-shaped rod, a clamp seat, a connection pipe, and a bracket. The support frame has a hollow post, a fork-shaped frame disposed on an upper portion of the hollow post, and a positioning seat disposed on a top portion of the hollow post. The positioning seat has a circular hole and a plurality of round holes. The connection pipe has a rear end having a pivot hole. The clamp seat has a through hole. The rear end of the connection pipe is inserted in the clamp seat. The bracket has a tube and a U-shaped rod connected to the tube. A lower end of the L-shaped rod is inserted in the hollow post through the circular hole of the positioning seat. A bolt fastens the clamp seat and the rear end of the connection pipe together through the through hole of the clamp seat and the pivot hole of the connection pipe. A front end of the connection pipe is inserted in the tube.

DETAILED DESCRIPTION OF THE INVENTION

Figure 1:
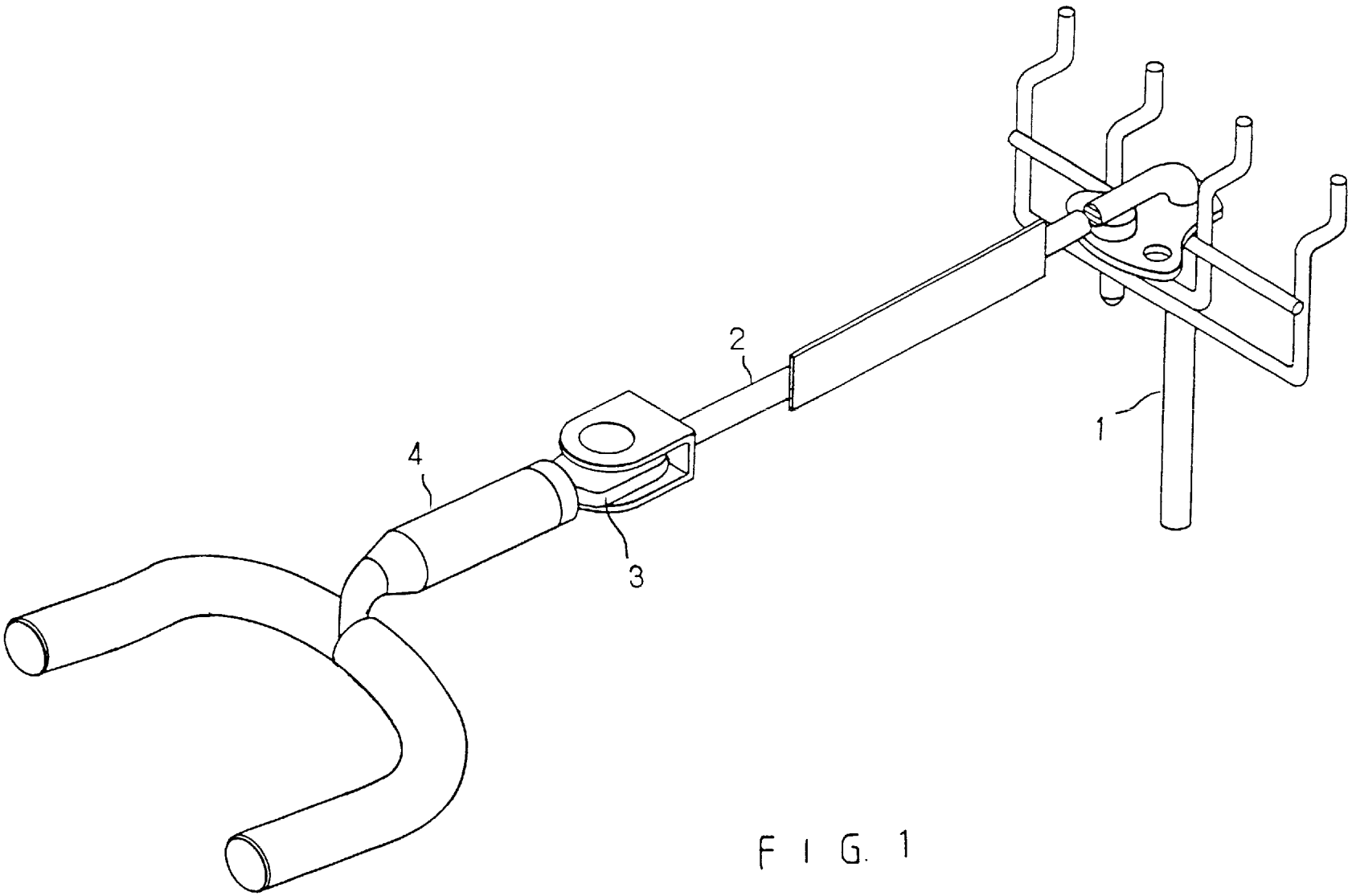
FIG. 1 is a perspective assembly view of a hanger of a preferred embodiment in accordance with the present invention.
Figure 2:
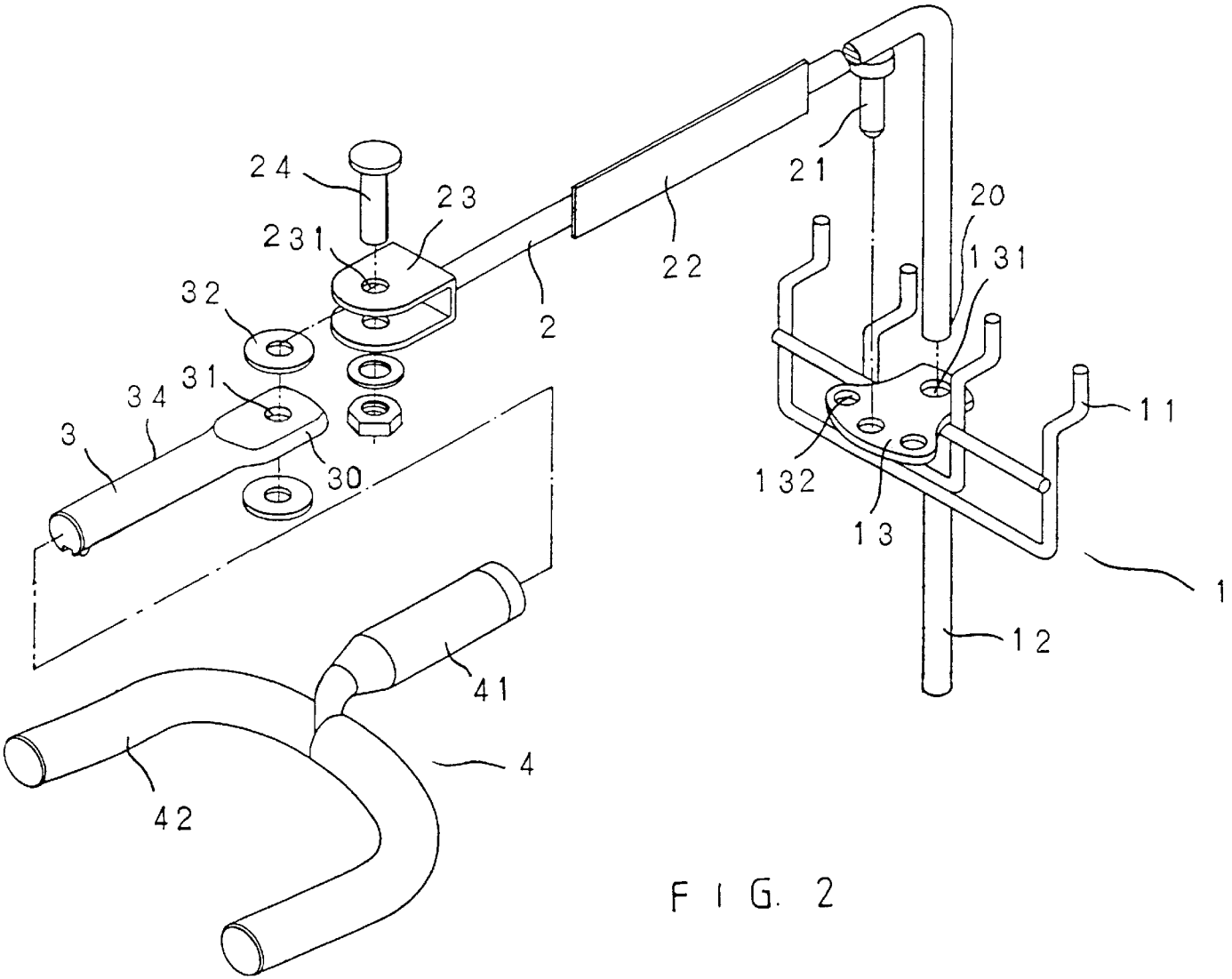
FIG. 2 is a perspective exploded view of a hanger of a preferred embodiment in accordance with the present invention.
Figure 3:
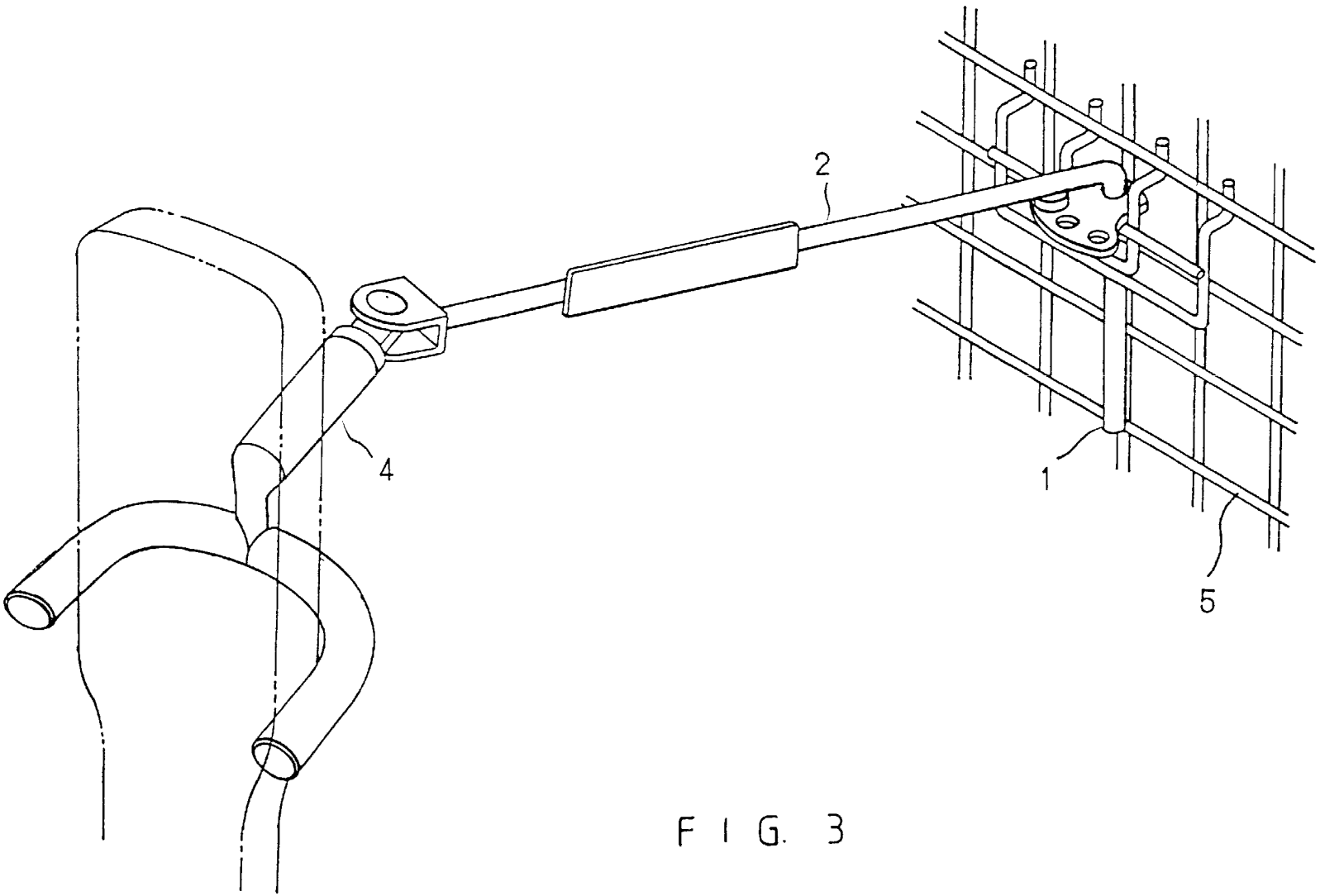
FIG. 3 is a schematic view illustrating an angle of a connection pipe being adjusted.
Figure 4:
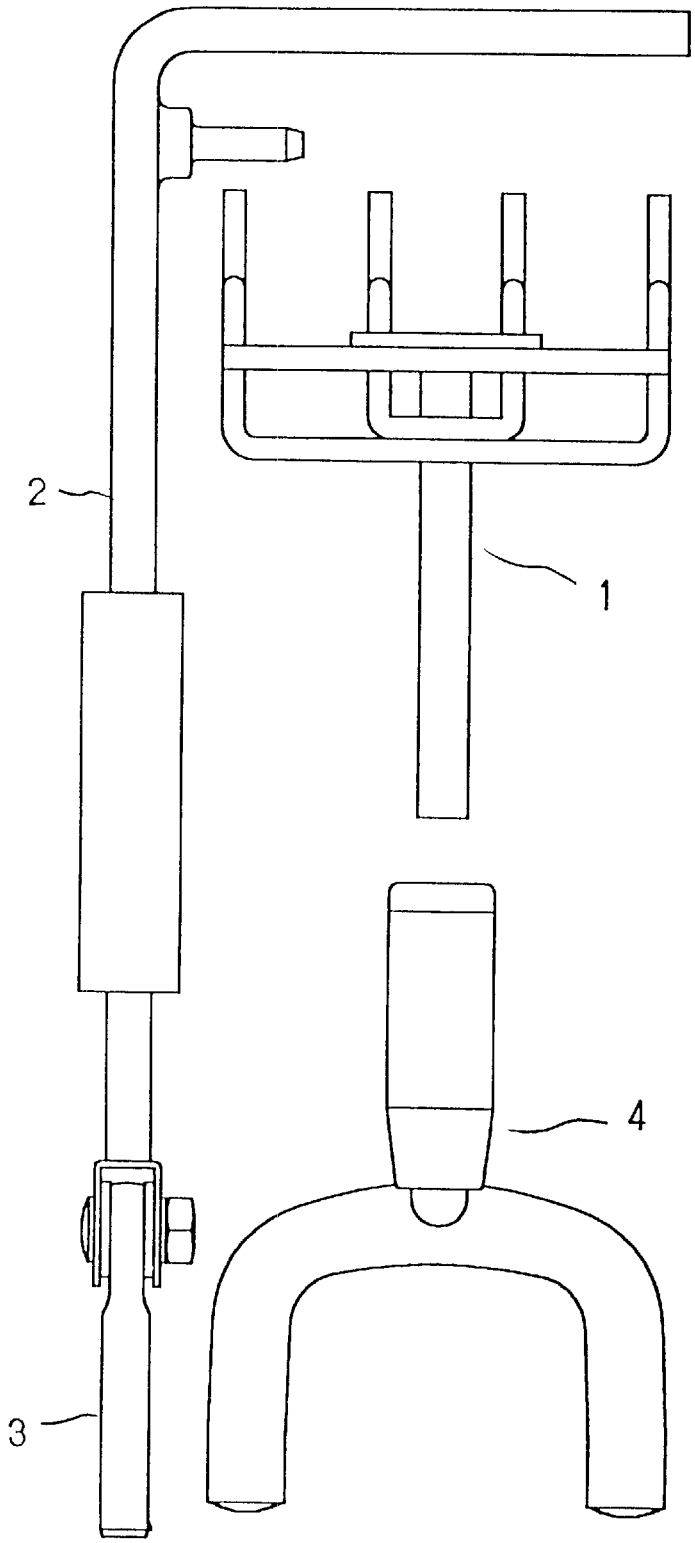
FIG. 4 is an elevational schematic view illustrating a hanger of a preferred embodiment being detached.

Referring to FIGS. 1 to 4, a hanger comprises a support frame 1, an L-shaped rod 2, a clamp seat 23, a connection pipe 3, and a bracket 4.

The support frame 1 has a hollow post 12, a fork-shaped frame 11 disposed on an upper portion of the hollow post 12, and a positioning seat 13 disposed on a top portion of the hollow post 12.

The positioning seat 13 has a circular hole 131 and a plurality of round holes 132.

The connection pipe 3 has a rear end 30 having a pivot hole 31.

The clamp seat 23 has a through hole 231.

The rear end 30 of the connection pipe 3 is inserted in the clamp seat 23.

Two washers 32 are disposed between the connection pipe 3 and the clamp seat 23.

The bracket 4 has a tube 41 and a U-shaped rod 42 connected to the tube 41.

A lower end 20 of the L-shaped rod 2 is inserted in the hollow post 12 through the circular hole 131 of the positioning seat 13.

A bolt 24 fastens the clamp seat 23 and the rear end 30 of the connection pipe 3 together through the through hole 231 of the clamp seat 23, the washers 32 and the pivot hole 31 of the connection pipe 3.

A front end 34 of the connection pipe 3 is inserted in the tube 41.

A positioning rod 21 is disposed on the L-shaped rod 2.

The positioning rod 21 is inserted through one of the round holes 132 of the positioning seat 13.

The clamp seat 23 has a generally U shape.

A label plate 22 is disposed on the L-shaped rod 2.

Referring to FIG. 3 again, a net 5 engages with the fork-shaped frame 11.

The present invention is not limited to the above embodiments but various modifications thereof may be made. Furthermore, various changes in form and detail may be made without departing from the scope of the present invention.

I claim:

1. A hanger comprises:

a support frame, an L-shaped rod, a clamp seat, a connection pipe, and a bracket, the support frame having a hollow post, a fork-shaped frame disposed on an upper portion of the hollow post, and a positioning seat disposed on a top portion of the hollow post, the positioning seat having a circular hole and a plurality of round holes, the connection pipe having a rear end having a pivot hole, the clamp seat having a through hole, the rear end of the connection pipe inserted in the clamp seat, the bracket having a tube and a U-shaped rod connected to the tube, a lower end of the L-shaped rod inserted in the hollow post through the circular hole of the positioning seat, a bolt fastening the clamp seat and the rear end of the connection pipe together through the through hole of the clamp seat and the pivot hole of the connection pipe, and a front end of the connection pipe inserted in the tube.

2. The hanger as claimed in claim 1, wherein a positioning rod is disposed on the L-shaped rod.

3. The hanger as claimed in claim 2, wherein the positioning rod is inserted through one of the round holes of the positioning seat.

4. The hanger as claimed in claim 1, wherein the clamp seat has a generally U shape.

5. The hanger as claimed in claim 1, wherein a label plate is disposed on the L-shaped rod.

* * * * *